US010378797B2

(12) United States Patent
Yamada

(10) Patent No.: US 10,378,797 B2
(45) Date of Patent: Aug. 13, 2019

(54) CRYOCOOLER

(71) Applicant: SUMITOMO HEAVY INDUSTRIES, LTD., Tokyo (JP)

(72) Inventor: Koji Yamada, Nishitokyo (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 249 days.

(21) Appl. No.: 15/608,760

(22) Filed: May 30, 2017

(65) Prior Publication Data

US 2017/0343249 A1 Nov. 30, 2017

(30) Foreign Application Priority Data

May 31, 2016 (JP) ..... 2016-108965

(51) Int. Cl.
*F25B 9/14* (2006.01)

(52) U.S. Cl.
CPC ..... *F25B 9/14* (2013.01); *F25B 2309/003* (2013.01); *F25B 2309/006* (2013.01); *F25B 2309/1428* (2013.01)

(58) Field of Classification Search
CPC ..... F25B 9/14; F25B 9/145; F25B 2309/003; F25B 2309/006; F25B 2309/1428; F16K 25/005
See application file for complete search history.

(56) References Cited

U.S. PATENT DOCUMENTS 5,746,269 A * 5/1998 Torii ..... F28D 17/02 165/10
2014/0208774 A1* 7/2014 Morie ..... F25B 9/14 62/6
2016/0252276 A1* 9/2016 Xu ..... F25B 9/06 62/402

FOREIGN PATENT DOCUMENTS

JP 2001-241796 A 9/2001
JP 2007-205581 A 8/2007

* cited by examiner

*Primary Examiner* — Keith M Raymond
*Assistant Examiner* — Webeshet Mengesha
(74) *Attorney, Agent, or Firm* — HEA Law PLLC

(57) ABSTRACT

A cryocooler includes: a housing internally defining a low-pressure gas chamber; a valve stator defining a variable pressure zone and a high-pressure zone between the housing and the valve stator; a valve rotor, a first seal member disposed adjacent to the high-pressure zone to seal the high-pressure zone and encompassing a first surface area; a second seal member disposed adjacent to the variable pressure zone to seal the variable pressure zone, and encompassing a second surface area that is larger than the first surface area; and a third seal member disposed adjacent to the variable pressure zone to seal the variable pressure zone, and encompassing a third surface area that is larger than the second surface area.

5 Claims, 8 Drawing Sheets

34b

CRYOCOOLER

RELATED APPLICATIONS

Priority is claimed to Japanese Patent Application No. 2016-108965, filed May 31, 2016, the entire content of which is incorporated herein by reference.

BACKGROUND

Technical Field

Certain embodiments of the present invention relate to cryocoolers.

Description of Related Art

Cryocoolers, typified by Gifford-McMahon (GM) refrigerators, include working-gas (also called refrigerant-gas) expanders and compressors. Expanders for the most part include a displacer that is axially reciprocated by a driving means, and a regenerator that is built into the displacer. The displacer is accommodated in a cylinder that guides its reciprocation. The variable volume that by the relative movement of the displacer with respect to the cylinder is formed between the two is employed as the working-gas expansion chamber. Appropriate synchronizing of the expansion-chamber volume change and pressure change enables the expander to produce coldness.

For that purpose, the cryocooler is furnished with a valve component for controlling pressure in the expansion chamber. The valve component is configured such as to switch in alternation between supply of high-pressure working gas from the compressor into the expander, and recovery of low-pressure working gas from the expander into the compressor. An ordinary rotary valve mechanism is employed as the valve component. The valve stator and valve rotor of the rotary valve mechanism are pressed against each other such as to prevent or otherwise minimize gas leakage along the contact surface between the valve stator and the valve rotor. In order to press them into contact, pressure differential between the contact surface and a rear surface of the valve stator can be exploited.

SUMMARY

The present invention in one embodiment affords a cryocooler, including: a housing internally defining a low-pressure gas chamber; a valve stator fixed to the housing in the low-pressure gas chamber, and defining a variable pressure zone and a high-pressure zone between the housing and the valve stator; a valve rotor supported on the housing such as to be rotatable, around a valve rotational axis, with respect to the valve stator in the low-pressure gas chamber, and configured to interconnect the high-pressure zone with the variable pressure zone during a portion of a single cycle of rotation of the valve rotor, and to interconnect the low-pressure gas chamber with the variable pressure zone in another portion of the single cycle; a first seal member extending lengthwise around the valve rotational axis between the housing and the valve stator, being disposed adjacent to the high-pressure zone to seal the high-pressure zone, and encompassing a first surface area; a second seal member extending lengthwise around the valve rotational axis between the housing and the valve stator, being disposed adjacent to the variable pressure zone to seal the variable pressure zone, and encompassing a second surface area that is larger than the first surface area; and a third seal member extending lengthwise around the valve rotational axis between the housing and the valve stator, being disposed adjacent to the variable pressure zone to seal the variable pressure zone, and encompassing a third surface area that is larger than the second surface area.

DETAILED DESCRIPTION

Figure 1:
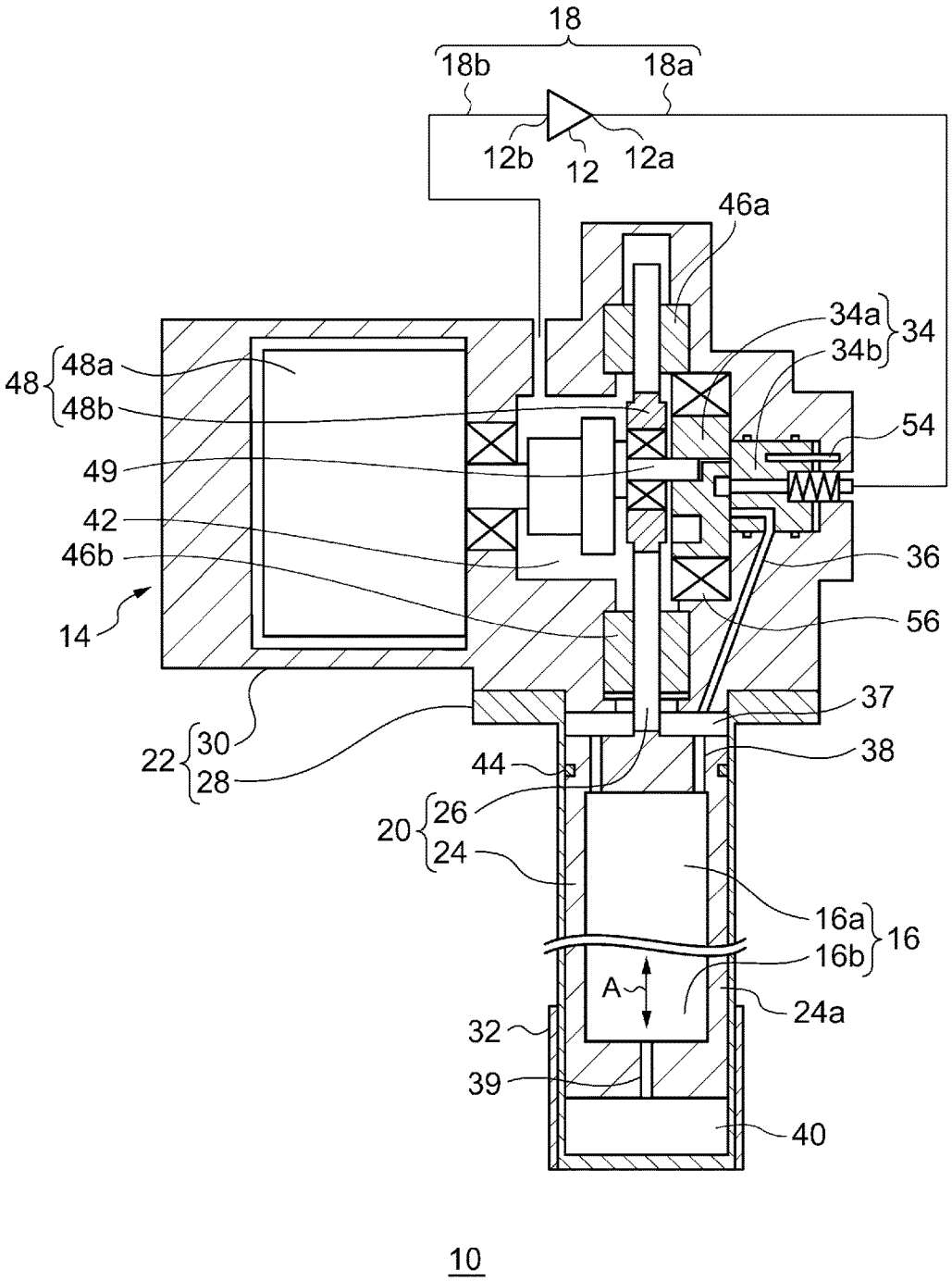
FIG. 1 is a view schematically showing a cryocooler according to an embodiment.

Gas pressure generated on the contact surface between the valve stator and the valve rotor may vary during a single cycle of valve rotation. Accordingly, the pressure difference due to the pressing may also vary. For example, the pressure difference becomes the minimum in a supply state of a high-pressure working gas and the pressure difference becomes the maximum in a recovery state of a low-pressure working gas. A pressing force between the valve stator and the valve rotor may vary according to the variation of the pressure difference.

It is desirable to decrease the variation of the pressing force which is applied to a portion between the valve stator and the valve rotor of the cryocooler.

According to an aspect of the present invention, it is possible to prevent variation of the pressing force which is applied to a portion between the valve stator and a valve rotor of the cryocooler.

Hereinafter, embodiments of the present invention will be described in detail with reference to the drawings. In addition, in descriptions thereof, the same reference numerals are assigned to the same elements, and overlapping descriptions are appropriately omitted. Moreover, configurations described below are exemplified and do not limit the scope of the present invention.

FIG. 1 is a view schematically showing a cryocooler 10 according to an embodiment. The cryocooler 10 includes a compressor 12 which compresses a working gas and an expander 14 which cools the working gas by adiabatic expansion. For example, the working gas is helium gas. The expander 14 may be also referred to as a cold head. A regenerator 16 which pre-cools the working gas is included in the expander 14. The cryocooler 10 includes a gas pipe 18 which includes a first pipe 18*a* and a second pipe 18*b* which are respectively connected to the compressor 12 and the expander 14. The shown cryocooler 10 is a single-stage GM cryocooler.

As is well known, a working gas having a first high-pressure is supplied from a discharging port 12*a* of the compressor 12 to the expander 14 through the first pipe 18*a*. The pressure of the working gas is decreased from the first high-pressure to a second high-pressure which is lower than the first high-pressure due to adiabatic expansion in the expander 14. The working gas having the second high-pressure is returned from the expander 14 to a suction port 12*b* of the compressor 12 through the second pipe 18*b*. The compressor 12 compresses the returned working gas having the second high-pressure. Accordingly, the pressure of the working gas increases to the first high-pressure again. In general, the first high-pressure and the second high-pressure are significantly higher than the atmospheric pressure. For convenience of descriptions, the first high-pressure and the second high-pressure are simply referred to as a high pressure and a low pressure, respectively. Typically, for example, the high pressure is 2 to 3 MPa, and the low pressure is 0.5 to 1.5 MPa. For example, a difference between the high pressure and the low pressure is approximately 1.2 to 2 MPa.

The expander 14 includes an expander movable portion 20 and an expander stationary portion 22. The expander movable portion 20 is configured so as to reciprocate in an axial direction (up-down direction in FIG. 1) with respect to the expander stationary portion 22. The movement direction of the expander movable portion 20 is indicated by an arrow A in FIG. 1. The expander stationary portion 22 is configured so as to support the expander movable portion 20 to be reciprocated in the axial direction. In addition, the expander stationary portion 22 is configured of an airtight container in which the expander movable portion 20 is accommodated along with a high-pressure gas (including first high-pressure gas and second high-pressure gas).

The expander movable portion 20 includes a displacer 24 and a displacer drive shaft 26 which reciprocates the displacer 24. A regenerator 16 is built in the displacer 24. The displacer 24 includes a displacer member 24*a* which surrounds the regenerator 16. An internal space of the displacer member 24*a* is filled with a regenerator material. Accordingly, the regenerator 16 is formed inside the displacer 24. For example, the displacer 24 has a substantially columnar shape which extends in the axial direction. The displacer member 24*a* includes an outer diameter and an inner diameter which are substantially constant in the axial direction. Accordingly, the regenerator 16 also has a substantially columnar shape which extends in the axial direction.

The expander stationary portion 22 approximately has two configurations which includes a cylinder 28 and a drive mechanism housing (hereinafter, simply referred to as a housing) 30. The upper portion of the expander stationary portion 22 in the axial direction is the housing 30, the lower portion of the expander stationary portion 22 in the axial direction is the cylinder 28, and the housing 30 and the cylinder 28 are firmly connected to each other. The cylinder 28 is configured to guide the reciprocation of the displacer 24. The cylinder 28 extends in the axial direction from the housing 30. The cylinder 28 has an inner diameter which is substantially constant in the axial direction, and accordingly, the cylinder 28 has a substantially cylindrical inner surface which extends in the axial direction. The inner diameter is slightly greater than the outer diameter of the displacer member 24*a*.

Moreover, the expander stationary portion 22 includes a cooling stage 32. The cooling stage 32 is fixed to the terminal of the cylinder 28 on the side opposite to the housing 30 in the axial direction. The cooling stage 32 is provided so as to transmit coldness generated by the expander 14 to other objects. The objects are attached to the cooling stage 32, and are cooled by the cooling stage 32 during the operation of the cryocooler 10.

In the present specification, for convenience of the description, terms such as an axial direction, a radial direction, and a circumferential direction are used. As shown by an arrow A, the axial direction indicates the movement direction of the expander movable portion 20 with respect to the expander stationary portion 22. The radial direction indicates a direction (a lateral direction in the drawing) perpendicular to the axial direction, and the circumferential direction indicates a direction which surrounds the axial direction. An element of the expander 14 being close to the cooling stage 32 in the axial direction may be referred to "down," and the element being far from the cooling stage 32 in the axial direction may be referred to as "up." Accordingly, a high-temperature portion and a low-temperature portion of the expander 14 are respectively positioned on the upper portion and the lower portion in the axial direction. The expressions are used so as to only assist understanding of a relative positional relationship between elements of the expander 14. Accordingly, the expressions are not related to the disposition of the expander 14 when the expander 14 is installed in site. For example, in the expander 14, the cooling stage 32 may be installed upward and the drive mechanism housing 30 may be installed downward. Alternatively, the expander 14 may be installed such that the axial direction coincides with a horizontal direction.

In addition, in the rotary valve mechanism, terms such as an axial direction, a radial direction, and a circumferential direction are used. In this case, the axial direction indicates a direction of a rotation axis of the rotary valve mechanism. The direction of the rotation axis of the rotary valve is orthogonal to the axial direction of the expander.

During the operation of the cryocooler 10, the regenerator 16 includes a regenerator high-temperature portion 16*a* on one side (upper side in the drawing) in the axial direction, and a regenerator low-temperature portion 16*b* on the side (lower side in the drawing) opposite to the regenerator high-temperature portion 16*a*. In this way, the regenerator 16 has a temperature distribution in the axial direction. Similarly, other components (for example, displacer 24 and cylinder 28) of the expander 14 which surrounds the regenerator 16 also have axial temperature distributions. Accordingly, the expander 14 includes a high-temperature portion on one side in the axial direction and a low-temperature portion on the other side in the axial direction during the operation of the expander 14. For example, the high-temperature portion has a temperature such as an approximately room temperature. The cooling temperatures of the low-temperature portion are different from each other according to the use of the cryocooler 10, and for example, the low-temperature portion is cooled to a temperature which is included in a range from approximately 10K to approximately 100K. The cooling stage 32 is fixed to the cylinder 28 to enclose the low-temperature portion of the cylinder 28.

A configuration of a working gas flow path in the expander 14 is described. The expander 14 includes a valve portion 34, a housing gas flow path 36, an upper gas chamber 37, a displacer upper gas flow path 38, a displacer lower gas flow path 39, a gas expansion chamber 40, and a low-pressure gas chamber 42. A high-pressure gas flows from the first pipe 18*a* into the gas expansion chamber 40 via the valve portion 34, the housing gas flow path 36, the upper gas chamber 37, the displacer upper gas flow path 38, the regenerator 16, and the displacer lower gas flow path 39. The gas returned to the gas expansion chamber 40 flows to the low-pressure gas chamber 42 via the displacer lower gas flow path 39, the regenerator 16, the displacer upper gas flow path 38, the upper gas chamber 37, the housing gas flow path 36, and the valve portion 34.

Although it is described below in detail, the valve portion 34 is configured to control the pressure of the gas expansion chamber 40 to be synchronized with the reciprocation of the displacer 24. The valve portion 34 functions as a portion of a supply path for supplying a high-pressure gas to the gas expansion chamber 40, and functions as a portion of a discharging path for discharging a low-pressure gas from the gas expansion chamber 40. The valve portion 34 is configured to end the discharging of the low-pressure gas and to start the supply of the high-pressure gas when the displacer 24 passes a bottom dead center or the vicinity thereof. The valve portion 34 is configured to end the supply of the high-pressure gas and to start the discharging of the low-pressure gas when the displacer 24 passes a top dead center or the vicinity thereof. In this way, the valve portion 34 is configured to switch the supply function and the discharging function of the working gas to be synchronized with the reciprocation of the displacer 24.

The housing gas flow path 36 is formed so as to penetrate the housing 30 such that gas flows between the expander stationary portion 22 and the upper gas chamber 37. The housing gas flow path 36 is formed in the housing 30 and is open to the upper gas chamber 37. The housing gas flow path 36 starts from the valve portion 34 and terminates at the upper gas chamber 37. That is, one end of the housing gas flow path 36 is connected to a gas passage of the valve portion 34 and the other end of the housing gas flow path 36 is connected to the upper gas chamber 37.

The upper gas chamber 37 is formed between the expander stationary portion 22 and the displacer 24 on the regenerator high-temperature portion 16*a* side. More specifically, the upper gas chamber 37 is interposed between the housing 30 and the displacer 24 in the axial direction, and is surrounded by the cylinder 28 in the circumferential direction. The upper gas chamber 37 is adjacent to the low-pressure gas chamber 42. The upper gas chamber 37 is also referred to as a room temperature chamber. The upper gas chamber 37 is a variable volume which is formed between the expander movable portion 20 and the expander stationary portion 22.

The displacer upper gas flow path 38 is at least one hole of the displacer member 24*a* which is formed to interconnect the regenerator high-temperature portion 16*a* with the upper gas chamber 37. The displacer lower gas flow path 39 is at least one hole of the displacer member 24*a* which is formed to interconnect the regenerator low-temperature portion 16*b* with the gas expansion chamber 40. A seal portion 44 which seals a clearance between the displacer 24 and the cylinder 28 is provided on the side surface of the displacer member 24*a*. The seal portion 44 may be attached to the displacer member 24*a* so as to surround the displacer upper gas flow path 38 in the circumferential direction.

The gas expansion chamber 40 is formed between the cylinder 28 and the displacer 24 on the regenerator low-temperature portion 16*b* side. Similarly to the upper gas chamber 37, the gas expansion chamber 40 is a variable volume which is formed between the expander movable portion 20 and the expander stationary portion 22, and the volume of the gas expansion chamber 40 is complementarily changed with the volume of the upper gas chamber 37 by the relative movement of the displacer 24 with respect to the cylinder 28. Since the seal portion 44 is provided, a direct gas flow (that is, the flow of gas which bypasses the regenerator 16) between the upper gas chamber 37 and the gas expansion chamber 40 is not generated.

The low-pressure gas chamber 42 is defined inside the housing 30. The second pipe 18*b* is connected to the housing 30. Accordingly, the low-pressure gas chamber 42 communicates with the suction port 12*b* of the compressor 12 through the second pipe 18*b*. Therefore, the low-pressure gas chamber 42 is always maintained to a low pressure.

A drive configuration of the expander 14 will be described. As shown in FIG. 1, the displacer drive shaft 26 protrudes from the displacer 24 to the low-pressure gas chamber 42 through the upper gas chamber 37. The expander stationary portion 22 includes a pair of drive shaft guides 46*a* and 46*b* which support the displacer drive shaft 26 in the axial direction in a movable manner. Each of the drive shaft guides 46*a* and 46*b* is provided in housing 30 so as to surround the displacer drive shaft 26. The drive shaft guide 46*b* positioned on the lower side in the axial direction or the lower end section of the housing 30 is airtightly configured. Accordingly, the low-pressure gas chamber 42 is separated from the upper gas chamber 37. The direct gas flow between the low-pressure gas chamber 42 and the upper gas chamber 37 is not generated.

The expander 14 includes a drive mechanism 48 which drives the displacer 24. The drive mechanism 48 is accommodated in the low-pressure gas chamber 42 and includes a motor 48*a* and a scotch yoke mechanism 48*b*. The displacer drive shaft 26 forms a portion of the scotch yoke mechanism 48*b*. In addition, the scotch yoke mechanism 48*b* includes a crank pin 49 which extends to be parallel to the output shaft of the motor 48*a* and is eccentric to the output shaft. The displacer drive shaft 26 is connected to the scotch yoke mechanism 48*b* to be driven in the axial direction by the scotch yoke mechanism 48*b*. Accordingly, the displacer 24 is reciprocated in the axial direction by the rotation of the motor 48*a*. The scotch yoke mechanism 48*b* is interposed between the drive shaft guides 46*a* and 46*b*, and the drive shaft guides 46*a* and 46*b* are positioned at different positions from each other in the axial direction.

The valve portion 34 is connected to the drive mechanism 48 and is accommodated in the housing 30. The valve portion 34 is a rotary valve type valve portion. The valve portion 34 includes a rotor valve resin member (hereinafter, may be simply referred to as a valve rotor) 34*a* and a stator valve metal member (hereinafter, may be simply referred to as a valve rotor) 34*b*. That is, the valve rotor 34*a* is formed of a resin material (for example, engineering plastic material or fluororesin material), and the valve stator 34*b* is formed of metal (for example, aluminum material or steel material). Conversely, the valve rotor 34*a* may be formed of metal and the valve stator 34*b* may be formed of a resin. The valve rotor 34*a* and the valve stator 34*b* may be respectively referred to as a valve disk and a valve main body.

The valve rotor 34*a* and the valve stator 34*b* are disposed in the low-pressure gas chamber 42. The valve rotor 34*a* is connected to the output shaft of the motor 48*a* so as to be rotated by the rotation of the motor 48*a*. The valve rotor 34*a* is in surface-contact with the valve stator 34*b* so as to rotationally slide on the valve stator 34*b*. The valve stator 34*b* is fixed to the housing 30. The valve stator 34*b* is configured so as to receive the high-pressure gas which enters the housing 30 from the first pipe 18*a*.

The operation of the cryocooler 10 having the above-described configuration will be described. When the displacer 24 moves to the bottom dead center of the cylinder 28 or the position around the bottom dead center, the valve portion 34 is switched to connect the discharging port 12*a* of the compressor 12 to the gas expansion chamber 40. An intake process of the cryocooler 10 starts. The high-pressure gas enters the regenerator high-temperature portion 16*a* through the housing gas flow path 36, the upper gas chamber 37, and the displacer upper gas flow path 38 from the valve portion 34. The gas is cooled while passing through the regenerator 16 and enters the gas expansion chamber 40 through the displacer lower gas flow path 39 from the regenerator low-temperature portion 16*b*. While the gas flows into the gas expansion chamber 40, the displacer 24 moves toward the top dead center of the cylinder 28. Accordingly, the volume of the gas expansion chamber 40 increases. In this way, the gas expansion chamber 40 is filled with a high-pressure gas.

When the displacer 24 moves to the top dead center of the cylinder 28 or the position around the top dead center, the valve portion 34 is switched so as to connect the suction port 12*b* of the compressor 12 to the gas expansion chamber 40. The intake process ends and an exhaust process starts. The high-pressure gas is expanded and cooled in the gas expansion chamber 40. The expanded gas enters the regenerator 16 through the displacer lower gas flow path 39 from the gas expansion chamber 40. The gas is cooled while passing through the regenerator 16. The gas is returned from the regenerator 16 to the compressor 12 via the housing gas flow path 36, the valve portion 34, and the low-pressure gas chamber 42. While the gas flows out from the gas expansion chamber 40, the displacer 24 moves toward the bottom dead center of the cylinder 28. Accordingly, the volume of the gas expansion chamber 40 decreases and a low-pressure gas is discharged from the gas expansion chamber 40. If the exhaust process ends, the intake process starts again.

The above-described process is one-time cooling cycle in the cryocooler 10. The cryocooler 10 repeats the cooling cycle and cools the cooling stage 32 to a desired temperature. Accordingly, the cryocooler 10 can cool an object which is thermally connected to the cooling stage 32 to a cryogenic temperature.

Figure 2:
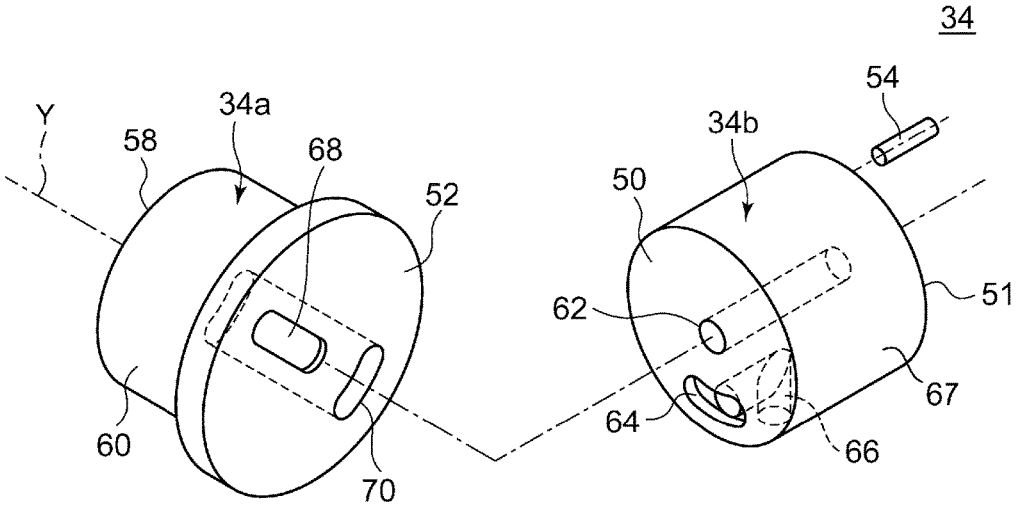
FIG. 2 is an exploded perspective view schematically showing a main portion of an exemplary valve portion used in the cryocooler shown in FIG. 1.

FIG. 2 is an exploded perspective view schematically showing a main portion of the exemplary valve portion 34 used in the cryocooler 10 shown in FIG. 1. The dotted-dashed line appearing in FIG. 2 indicates the valve's rotational axis Y.

The valve stator 34*b* has a stator flat surface 50 which is perpendicular to the valve rotational axis Y, and similarly, the valve rotor 34*a* has a rotor flat surface 52 which is perpendicular to the valve rotational axis Y. When the valve rotor 34*a* rotates with respect to the valve stator 34*b*, the rotor flat surface 52 rotationally slides on the stator flat surface 50. Since the stator flat surface 50 and the rotor flat surface 52 are in surface-contact with each other, leakage of a refrigerant gas is prevented.

The valve stator 34*b* is fixed to the inside of the housing 30 by a valve stator fixing pin 54. The valve stator fixing pin 54 engages with a valve stator end surface 51 which is positioned on the side opposite to the stator flat surface 50 of the valve stator 34*b* in the rotation axis direction, and regulates the rotation of the valve stator 34*b*.

The valve rotor 34*a* is rotatably supported by a rotor bearing 56 shown in FIG. 1. An engagement hole (not shown) which engages with the crank pin 49 is formed on a valve rotor end surface 58 which is positioned on a side opposite to the rotor flat surface 52 of the valve rotor 34*a* in the rotation axis direction. The motor 48*a* rotates the crank pin 49, and thereby, the valve rotor 34*a* rotates so as to be synchronized with the scotch yoke mechanism 48*b*. Moreover, the valve rotor 34*a* includes a rotor outer circumferential surface 60 which connects the rotor flat surface 52 to the valve rotor end surface 58. The rotor outer circumferential surface 60 is supported by the rotor bearing 56 and faces the low-pressure gas chamber 42.

The valve stator 34*b* includes a high-pressure gas inlet port 62 and a stator recessed portion 64. The high-pressure gas inlet port 62 is opened to the center portion of the stator flat surface 50, and is formed to penetrate the center portion of the valve stator 34*b* in the rotation axis direction. The high-pressure gas inlet port 62 defines a circular outline, which the valve rotational axis Y as a center, on the stator flat surface 50. The high-pressure gas inlet port 62 communicates with the discharging port 12*a* of the compressor 12 through the first pipe 18*a*. The stator recessed portion 64 is open outside the high-pressure gas inlet port 62 in the radial direction on the stator flat surface 50. The stator recessed portion 64 is formed in an arc shape which has the high-pressure gas inlet port 62 as a center. A depth of the stator recessed portion 64 is shorter than a length of the valve stator 34*b* in the rotation axis direction, and the stator recessed portion 64 does not penetrate the valve stator 34*b*.

The valve stator 34*b* includes a communication path 66 which is formed to penetrate the valve stator 34*b* so as to connect the stator recessed portion 64 to the housing gas flow path 36. Accordingly, the stator recessed portion 64 finally communicates with the gas expansion chamber 40 via the communication path 66 and the housing gas flow path 36. One end of the communication path 66 is open to the stator recessed portion 64 and the other end thereof is open to a stator side surface 67. While the portion of the communication path 66 on the stator recessed portion 64 side extends in the rotation axis direction, the portion of the communication path 66 on the housing gas flow path 36 side which is orthogonal to the portion of communication path 66 on the stator recessed portion 64 side extends in the radial direction. The stator side surface 67 is an outer circumferential surface of the valve stator 34*b* which extends around the valve rotational axis Y and connects the stator flat surface 50 to the valve stator end surface 51.

The low-pressure returned gas from the gas expansion chamber 40 to the stator recessed portion 64 and the communication path 66 in the exhaust process while the high-pressure gas flows to the stator recessed portion 64 and the communication path 66 in the intake process of the cryocooler 10.

The valve rotor 34*a* includes a rotor recessed portion 68 and a low-pressure gas discharging port 70 which is a second rotor recessed portion. The rotor flat surface 52 is in surface-contact with the stator flat surface 50 around the rotor recessed portion 68. Similarly, the rotor flat surface 52 is in surface-contact with the stator flat surface 50 around the low-pressure gas discharging port 70.

The rotor recessed portion 68 is open to the rotor flat surface 52 and is formed in an elliptical shape. The rotor recessed portion 68 extends from the center portion of the rotor flat surface 52 to the outside in the radial direction. A depth of the rotor recessed portion 68 is shorter than a length of the valve rotor 34*a* in the rotation axis direction, and the rotor recessed portion 68 does not penetrate the valve rotor 34*a*. The rotor recessed portion 68 is positioned at a location corresponding to the high-pressure gas inlet port 62 on the rotor flat surface 52, and the rotor recessed portion 68 always communicates with the high-pressure gas inlet port 62.

The rotor recessed portion 68 is formed in the valve rotor 34*a* so as to interconnect the high-pressure gas inlet port 62 with the stator recessed portion 64 in a portion (for example, intake process) of a single cycle of rotation of the valve rotor 34*a*, and not to interconnect the high-pressure gas inlet port 62 with the stator recessed portion 64 in a remaining portion (for example, exhaust process) of the single cycle. Two areas configured of the rotor recessed portion 68 and the high-pressure gas inlet port 62, or three areas configured of the rotor recessed portion 68, the high-pressure gas inlet port 62, and the stator recessed portion 64 form high-pressure regions (or high-pressure flow paths) which communicate with each other in the valve portion 34. The valve rotor 34*a* seals the high-pressure region and is disposed to be adjacent to the valve stator 34*b* so as to separate the high-pressure region from a low-pressure surrounding environment (that is, the low-pressure gas chamber 42). In this way, an intake valve is configured in the valve portion 34.

The low-pressure gas discharging port 70 is open to a side opposite to the rotor recessed portion 68 in the radial direction on the rotor flat surface 52 and is formed to penetrate the valve rotor 34*a* in the rotation axis direction. The low-pressure gas discharging port 70 penetrates from the rotor flat surface 52 of the valve rotor 34*a* to the valve rotor end surface 58. The low-pressure gas discharging port 70 forms a low-pressure flow path which communicates with the low-pressure gas chamber 42. The low-pressure gas discharging port 70 is formed so as to be positioned on approximately the same circumference as that of the stator recessed portion 64 of the valve stator 34*b*. The low-pressure gas discharging port 70 is formed in the valve rotor 34*a* to interconnect the stator recessed portion 64 with the low-pressure gas chamber 42 in at least a portion (for example, in the exhaust process) of the cycle during which the high-pressure gas inlet port 62 is not interconnected with the stator recessed portion 64. In this way, an exhaust valve is configured in the valve portion 34.

Figure 3A:
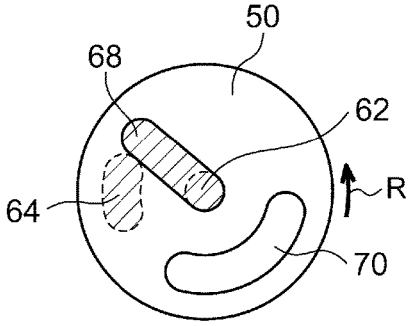
FIGS. 3A and 3B are views exemplifying an operation of the valve portion shown in FIG. 2.
Figure 3B:
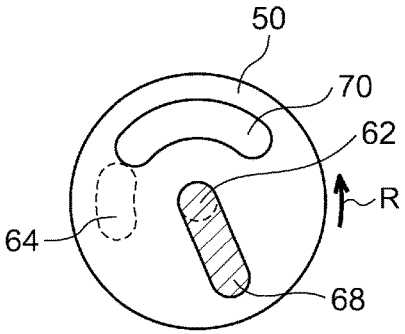

FIGS. 3A and 3B are view exemplifying an operation of the valve portion 34 shown in FIG. 2. FIGS. 3A and 3B show an aspect when the valve portion 34 is viewed so as to be transmitted from the valve rotor 34*a* side, and show relative positions between the high-pressure gas inlet port 62, the stator recessed portion 64, the rotor recessed portion 68, and the low-pressure gas discharging port 70. The valve rotor 34*a* rotates in a valve rotation direction R (counterclockwise direction in the drawings) with respect to the valve stator 34*b*. The high-pressure gas inlet port 62 and the stator recessed portion 64 of the valve stator 34*b* are shown by dashed lines, and the rotor recessed portion 68 and the low-pressure gas discharging port 70 of the valve rotor 34*a* are shown by solid lines.

FIG. 3A shows an aspect when the intake process starts. The rotor recessed portion 68 comes into contact with the stator recessed portion 64. Accordingly, the high-pressure gas inlet port 62 fluidically communicates with the stator recessed portion 64 through the rotor recessed portion 68. An area of the high-pressure region on the stator flat surface 50 is relatively large as shown by hatching. In a region outside the hatched portion, since the valve rotor 34*a* and the valve stator 34*b* are disposed in the low-pressure gas chamber 42, it is considered that the pressure of the region is approximately low. In this way, in the intake process, the area of the high-pressure region increases, and an average pressure applied to the stator flat surface 50 is relatively high.

FIG. 3B shows an aspect when the exhaust process starts. The low-pressure gas discharging port 70 comes into contact with the stator recessed portion 64. The rotor recessed portion 68 is fluidically separated from the stator recessed portion 64. Accordingly, an area of the high-pressure region on the stator flat surface 50 is limited to the rotor recessed portion 68 as shown by hatching and is relatively small. It is considered that a pressure of a region outside the hatched portion is approximately high. In this way, in the exhaust process, the area of the high-pressure region decreases, and the average pressure applied to the stator flat surface 50 is relatively low.

In this way, the pressure applied to the valve stator end surface 51 positioned on the side opposite to the stator flat surface 50 is not changed while the pressure applied to the stator flat surface 50 is changed according to the valve rotation. A high pressure is always applied to the valve stator end surface 51.

Accordingly, a pressure difference (that is, a pressure difference between the stator flat surface 50 and the valve stator end surface 51) applied to the valve stator 34*b* decreases in the intake process and increases in the exhaust process. The pressure difference is applied so as to press the valve stator 34*b* to the valve rotor 34*a*. Therefore, similarly, a pressing force applied to a portion between the valve stator 34*b* and the valve rotor 34*a* decreases in the intake process and increases in the exhaust process.

Figure 4:
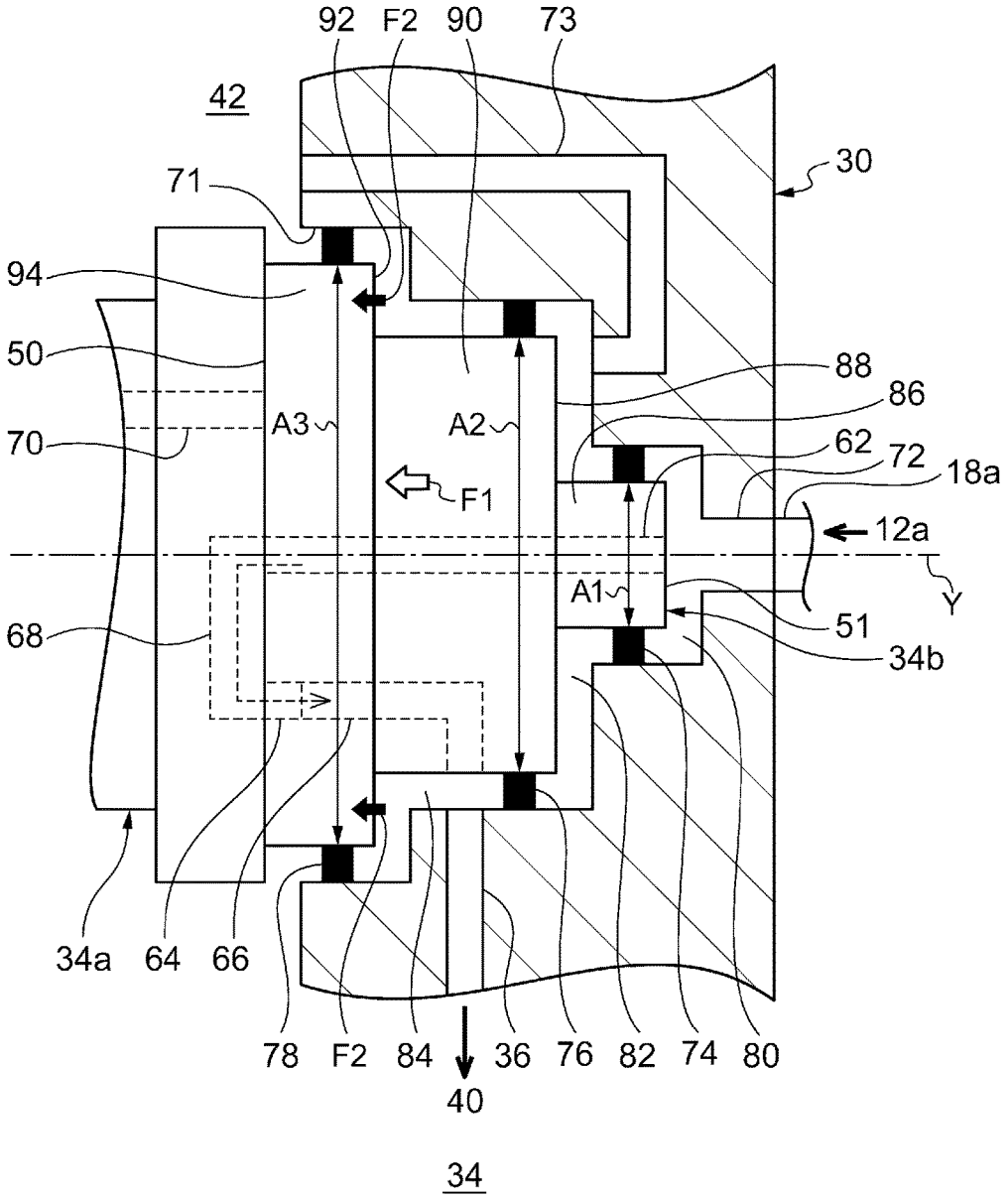
FIG. 4 is a view schematically showing a valve portion according to an embodiment and a peripheral structure thereof.
Figure 5:
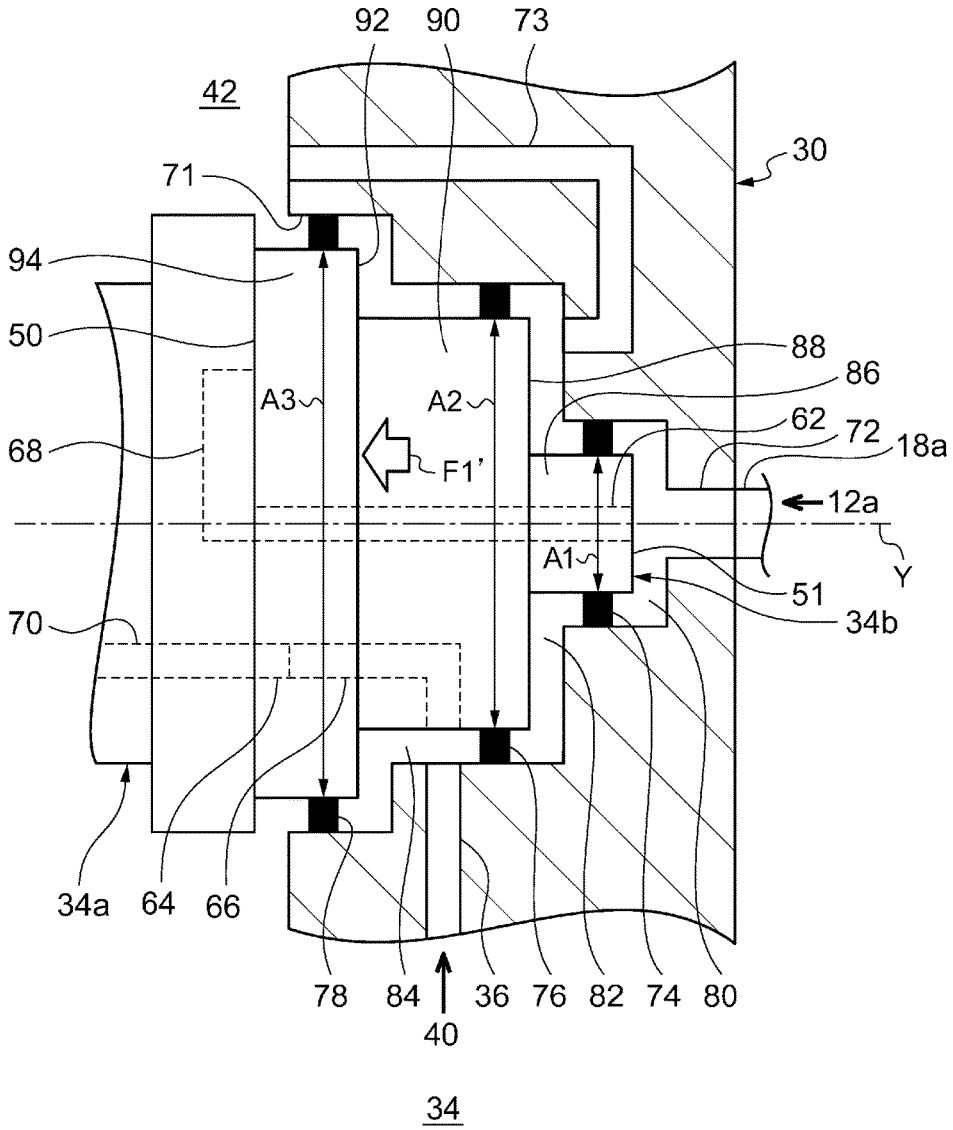
FIG. 5 is a view schematically showing the valve portion according to the embodiment and the peripheral structure thereof.

FIGS. 4 and 5 are views schematically showing the valve portion 34 according to an embodiment and a peripheral structure thereof. For understanding, FIG. 4 shows a configuration of a working gas flow path in the intake process by dashed lines, and FIG. 5 shows a configuration of a working gas flow path in the exhaust process by dashed lines. Moreover, FIG. 6 is a schematic top view of the valve stator 34*b* shown in FIGS. 4 and 5.

Figure 6:
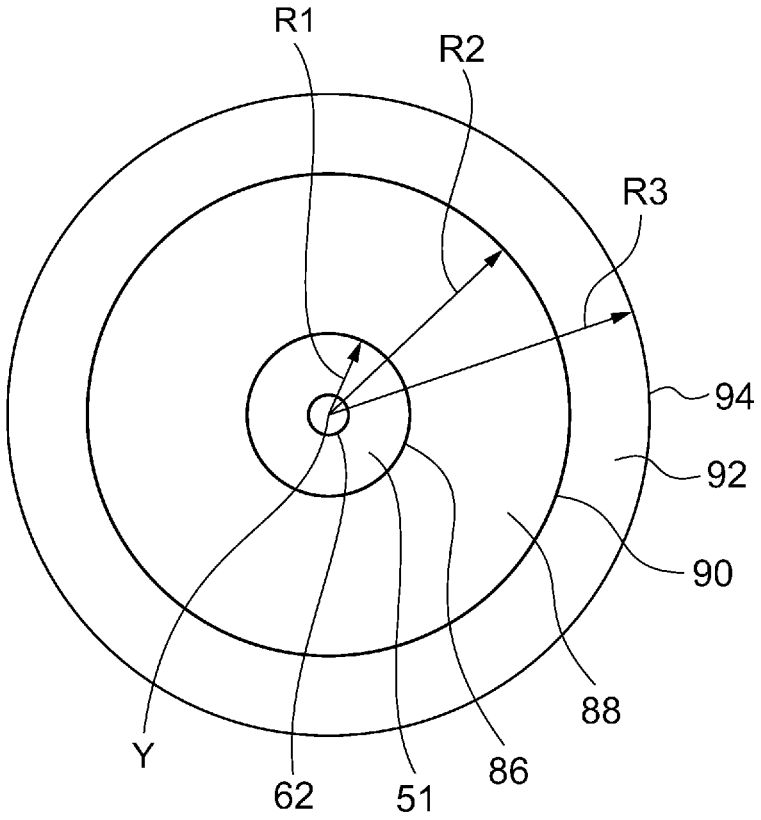
FIG. 6 is a schematic top view of a valve stator shown in FIGS. 4 and 5.

The valve portion 34 according to the embodiment shown in FIGS. 4 to 6 is different from the valve portion 34 having the valve stator 34*b* without a stage shown in FIG. 2 in that the valve stator 34*b* has a three-stage structure. Other characteristics of the valve stator 34*b* such as the gas flow path structure of the valve stator 34*b* and the fixing of the valve stator 34*b* with respect to the housing 30 may be similar to those of the valve stator 34*b* shown in FIGS. 4 to 6 and the valve stator 34*b* shown in FIG. 2. Accordingly, as shown by dashed lines, the high-pressure gas inlet port 62, the stator recessed portion 64, and the communication path 66 are formed inside the valve stator 34*b* shown in FIGS. 4 to 6. In addition, the valve rotor 34*a* shown in FIGS. 4 and 5 may be similar to the valve rotor 34*a* shown in FIG. 2. Accordingly, as shown by dashed lines, the rotor recessed portion 68 and the low-pressure gas discharging port 70 are formed inside the valve rotor 34*a* shown in FIGS. 4 and 5.

The housing 30 includes a stator receiving recessed surface 71 having a three-stage structure which receives the valve stator 34*b*. In addition to the above-described housing gas flow path 36, a high-pressure gas inlet 72 and a low-pressure introduction path 73 are formed in the housing 30.

The high-pressure gas inlet 72 is formed to penetrate the housing 30 so as to introduce a pressure (that is, a high pressure) from the discharging port 12*a* of the compressor 12 (refer to FIG. 1) into a clearance between the valve stator 34*b* and the stator receiving recessed surface 71. One end of the high-pressure gas inlet 72 is connected to the first pipe 18*a*, and the other end of the high-pressure gas inlet 72 is open to the stator receiving recessed surface 71. The high-pressure gas inlet 72 is open toward the valve stator end surface 51.

The low-pressure introduction path 73 is formed to penetrate the housing 30 so as to introduce a pressure (that is, a low pressure) from the low-pressure gas chamber 42 into a clearance between the valve stator 34*b* and the stator receiving recessed surface 71. One of the low-pressure introduction path 73 is connected to the low-pressure gas chamber 42, and the other end of the low-pressure introduction path 73 is open to the stator receiving recessed surface 71.

Three seal members corresponding to respective stages of the three-stage structure, that is, a first seal member 74, a second seal member 76, and a third seal member 78 are provided between the valve stator 34*b* and the stator receiving recessed surface 71. The clearance between the valve stator 34*b* and the stator receiving recessed surface 71 is divided into a high-pressure zone 80, a low-pressure zone 82, and a variable pressure zone 84 by the seal members. The seal members may be accommodated in seal member accommodation grooves which are formed on the valve stator 34*b* or the stator receiving recessed surface 71. Each of the seal members is a ring-shaped seal member, for example, is an O-ring.

In this way, the valve stator 34*b* defines the variable pressure zone 84 and the high-pressure zone 80 between the housing 30 and the valve stator 34*b* such that the low-pressure gas chamber 42, the variable pressure zone 84, and the high-pressure zone 80 are disposed in this order in the direction (right-left direction in FIGS. 4 and 5) of the valve rotational axis Y. More specifically, the valve stator 34*b* defines the variable pressure zone 84, a constant-pressure zone, and the high-pressure zone 80 between the housing 30 and the valve stator 34*b* such that the low-pressure gas chamber 42, the variable pressure zone 84, the constant-pressure zone, and the high-pressure zone 80 are disposed in this order in the direction of the valve rotational axis Y. The constant-pressure zone may be the low-pressure zone 82.

The valve rotor 34*a* is supported by the housing 30 so as to be rotatable around the valve rotational axis Y with respect to the valve stator 34*b* in the low-pressure gas chamber 42. The valve rotor 34*a* is disposed on the low-pressure gas chamber 42 side with respect to the variable pressure zone 84 in the direction of the valve rotational axis Y. The valve rotor 34*a* is configured such that the high-pressure zone 80 is interconnected with the variable pressure zone 84 in a portion (for example, intake process) of a single cycle of rotation of the valve rotor and the low-pressure gas chamber 42 is interconnected with the variable pressure zone 84 in another portion (for example, exhaust process) of the single cycle.

The first seal member 74 extends around the valve rotational axis Y between the housing 30 and the valve stator 34*b*. The first seal member 74 surrounds a first area A1. The first area A1 is an area in a cross section along a plane perpendicular to the valve rotational axis Y (this is similarly applied to a second area A2 and a third area A3 described later). The first seal member 74 is disposed to be adjacent to the high-pressure zone 80 so as to seal the high-pressure zone 80. The first seal member 74 is configured to seal the high-pressure zone 80 from the low-pressure zone 82.

The second seal member 76 extends around the valve rotational axis Y between the housing 30 and the valve stator 34*b*. The second seal member 76 surrounds the second area A2 which is larger than the first area A1. The second seal member 76 is disposed between the first seal member 74 and the valve rotor 34*a* in the direction of the valve rotational axis Y. The second seal member 76 is disposed to be adjacent to the variable pressure zone 84 so as to seal the variable pressure zone 84. The second seal member 76 is configured to seal the variable pressure zone 84 from the low-pressure zone 82.

The third seal member 78 extends around the valve rotational axis Y between the housing 30 and the valve stator 34*b*. The third seal member 78 surrounds the third area A3 which is larger than the second area A2. The third seal member 78 is disposed between the second seal member 76 and the valve rotor 34*a* in the direction of the valve rotational axis Y. The third seal member 78 is disposed to be adjacent to the variable pressure zone 84 so as to seal the variable pressure zone 84. The third seal member 78 is configured to seal the variable pressure zone 84 from the low-pressure gas chamber 42.

In addition to the above-described stator flat surface 50 and valve stator end surface 51, the valve stator 34*b* includes a stator outer circumferential surface which faces the stator receiving recessed surface 71 and connects the stator flat surface 50 to the valve stator end surface 51. The stator circumferential surface includes three stage portions. Specifically, the valve stator 34*b* includes a first stator circumferential surface 86, a first stator stage portion 88, a second stator circumferential surface 90, a second stator stage portion 92, and a third stator circumferential surface 94. Since the outline of the valve stator 34*b* has an axisymmetric shape about the valve rotational axis Y, the first stator circumferential surface 86, the first stator stage portion 88, the second stator circumferential surface 90, the second stator stage portion 92, and the third stator circumferential surface 94 are coaxial with the valve rotational axis Y.

The first stator circumferential surface 86 has a first radius R1 from the valve rotational axis Y to define the first area A1. The first stator circumferential surface 86 extends in the direction of the valve rotational axis Y to connect the valve stator end surface 51 to the first stator stage portion 88. The first seal member 74 extends around the valve rotational axis Y between the housing 30 and the first stator circumferential surface 86. The first seal member 74 is mounted to be interposed between the first stator circumferential surface 86 and the stator receiving recessed surface 71.

The first stator stage portion 88 is a flat annular region which spreads to the outside in the radial direction from the first stator circumferential surface 86. The first stator stage portion 88 is a parallel to a surface perpendicular to the valve rotational axis Y and faces the side opposite to the stator flat surface 50. The first stator stage portion 88 connects the first stator circumferential surface 86 to the second stator circumferential surface 90. An area of the first stator stage portion 88 is the same as a difference between the second area A2 and the first area A1.

The second stator circumferential surface 90 has a second radius R2 from the valve rotational axis Y to define the second area A2. The second radius R2 is larger than the first radius R1. The second stator circumferential surface 90 extends in the direction of the valve rotational axis Y to connect the first stator stage portion 88 to the second stator stage portion 92. The second seal member 76 extends along the valve rotational axis Y between the housing 30 and the second stator circumferential surface 90. The second seal member 76 is mounted so as to be interposed between the second stator circumferential surface 90 and the stator receiving recessed surface 71.

The second stator stage portion 92 is a flat annular region which spreads to the outside in the radial direction from the second stator circumferential surface 90. The second stator stage portion 92 is a parallel to a surface perpendicular to the valve rotational axis Y and faces the side opposite to the stator flat surface 50. The second stator stage portion 92 connects the second stator circumferential surface 90 to the third stator circumferential surface 94. An area of the second stator stage portion 92 is the same as a difference between the third area A3 and the second area A2.

The third stator circumferential surface 94 has a third radius R3 from the valve rotational axis Y to define the third area A3. The third radius R3 is larger than the second radius R2. The third stator circumferential surface 94 extends in the direction of the valve rotational axis Y to connect the second stator stage portion 92 to the stator flat surface 50. The third seal member 78 extends along the valve rotational axis Y between the housing 30 and the third stator circumferential surface 94. The third seal member 78 is mounted so as to be interposed between the third stator circumferential surface 94 and the stator receiving recessed surface 71.

The high-pressure gas inlet 72 of the housing 30 connects the high-pressure zone 80 to the first pipe 18*a*. Accordingly, a high pressure is introduced from the discharging port 12*a* of the compressor 12 (refer to FIG. 1) to the high-pressure zone 80. In addition, a high pressure is introduced from the high-pressure gas inlet 72 to the high-pressure gas inlet port 62 of the valve stator 34*b* through the high-pressure zone 80.

The low-pressure introduction path 73 of the housing 30 connects the low-pressure zone 82 to the low-pressure gas chamber 42. The low-pressure introduction path 73 is open to a portion (for example, toward the first stator stage portion 88) between the first seal member 74 and the second seal member 76 in the direction of the valve rotational axis Y. Accordingly, a low pressure is introduced from the low-pressure gas chamber 42 to the low-pressure zone 82.

As described above, the stator recessed portion 64 of the valve stator 34*b* is open to the stator flat surface 50. The communication path 66 extends from the stator recessed portion 64 to the variable pressure zone 84. The communication path 66 is open to the second stator circumferential surface 90 between the second seal member 76 and the third seal member 78 in the direction of the valve rotational axis Y. In addition, the housing gas flow path 36 connects the variable pressure zone 84 to the internal space (finally, the gas expansion chamber 40) of the cylinder 28 (refer to FIG. 1). The housing gas flow path 36 is open to a portion (for example, toward the communication path 66 on the second stator circumferential surface 90) between the second seal member 76 and the third seal member 78 in the direction of the valve rotational axis Y.

In this way, the variable pressure zone 84 is positioned in the middle of the working gas flow path from the valve portion 34 to the gas expansion chamber 40. Therefore, as shown in by dashed lines in FIG. 4, in the intake process, a high pressure is introduced from the high-pressure zone 80 to the variable pressure zone 84 through the high-pressure gas inlet port 62, the rotor recessed portion 68, the stator recessed portion 64, and the communication path 66. Meanwhile, in the exhaust process, a low pressure is introduced from the low-pressure gas chamber 42 to the variable pressure zone 84 through the low-pressure gas discharging port 70, the stator recessed portion 64, the communication path 66. In other words, the same pressure as that of the gas expansion chamber 40 is introduced into the variable pressure zone 84.

As described with reference to FIG. 3A, in the intake process, the pressure difference between the stator flat surface 50 and the valve stator end surface 51 decreases, and a pressing force F1 (refer to FIG. 4) due to the decrease in the pressure difference is relatively small. Meanwhile, as described above, in the intake process, a high pressure is introduced to the variable pressure zone 84. Accordingly, a high pressure is applied to the second stator stage portion 92, and therefore, a pressing force F2 assisting the pressing force F1 is added. Therefore, unlike the valve portion 34 shown in FIG. 2, according to the valve portion 34 of the embodiment shown in FIGS. 4 to 6, it is possible to at least partially compensate a decrease in the pressing force.

Meanwhile, as described with reference to FIG. 3B, in the exhaust process, the pressure difference between the stator flat surface 50 and the valve stator end surface 51 increases, and a pressing force F1' (refer to FIG. 5) due to the increase in the pressure difference is relatively large. As described above, in this case, a low pressure is introduced to the variable pressure zone 84. Since a low pressure is applied to the second stator stage portion 92, an assisting pressing force F2 is not generated. Therefore, unlike the valve portion 34 shown in FIG. 2, according to the valve portion 34 of the embodiment shown in FIGS. 4 to 6, it is possible to prevent variation in the pressing forces between the intake process and the exhaust process.

As described above, according to this embodiment, the valve portion 34 is configured to press the valve stator 34*b* to the valve rotor 34*a* using the pressure difference applied to the valve stator 34*b*. The second seal member 76 and the third seal member 78 which is larger than the second seal member 76 are provided in the valve portion 34. The variable pressure zone 84 having a common pressure with the gas expansion chamber 40 is defined between the second seal member 76 and the third seal member 78 due to the second seal member 76 and the third seal member 78. The valve stator 34*b* in the variable pressure zone 84 has a surface (for example, second stator stage portion 92) facing the opposite to the stator flat surface 50 so as to receive a variable pressure. According to this configuration, it is possible to decrease the variation of the pressing forces applied to a portion between the valve stator 34*b* and the valve rotor 34*a* during a single cycle of the rotation of the valve portion 34 of the cryocooler 10.

In addition, the first seal member 74 which is smaller than the second seal member 76 is provided in the valve portion 34. The low-pressure zone 82 is defined between the first seal member 74 and the second seal member 76 due to the first seal member 74 and the second seal member 76. The valve stator 34*b* in the low-pressure zone 82 has a surface (for example, first stator stage portion 88) facing the opposite to the stator flat surface 50 so as to receive a low pressure. Accordingly, the low-pressure zone 82 has effects of decreasing the pressing force applied to the valve rotor 34*a* of the valve stator 34*b*. Accordingly, it is possible to decrease a force (that is, sliding torque of the valve portion 34) for rotationally sliding the valve rotor 34*a* on the valve stator 34*b*. This contributes to miniaturization of a drive source (for example, the motor 48*a* shown in FIG. 1) for driving the valve portion 34.

As described above, since the valve stator 34*b* has the three-stage structure and three seal members are provided, it is possible to decrease the variation of the pressing forces applied to the portion between the valve stator 34*b* and the valve rotor 34*a* and it is possible to decrease sliding torque of the valve portion 34.

The valve stator 34*b* is slightly displaced in the direction of the valve rotational axis Y by effects of the pressure difference. In a case where the pressure differences in the intake process and the exhaust process are different from each other, the positions of the valve stator 34*b* in the intake process and the exhaust process may be different from each other. The first seal member 74, the second seal member 76, and the third seal member 78 are respectively mounted between the first stator circumferential surface 86 and the stator receiving recessed surface 71, between the second stator circumferential surface 90 and the stator receiving recessed surface 71, and the third stator circumferential surface 94 and the stator receiving recessed surface 71. Since the size of the gaps in the radial direction are not changed by the displacement of the valve stator 34*b* in the axial direction, sealability of the seal members is held in the intake process and the exhaust process.

A difference between the third radius R3 and the second radius R2 may be 10% or less of the maximum radius (for example, the third radius R3) of the valve stator 34*b*. The difference between the third radius R3 and the second radius R2 may be 1% or more of the maximum radius of the valve stator 34*b*. In this way, it is possible to finely adjust the pressing force F2 assisting the pressing force F1.

Hereinbefore, the present invention is described based on the embodiment. The present invention is not limited to the embodiment, and a person skilled in the art understands that various design modifications can be applied, various modification examples can be applied, and the modification examples are also included in the scope of the present invention.

Figure 7:
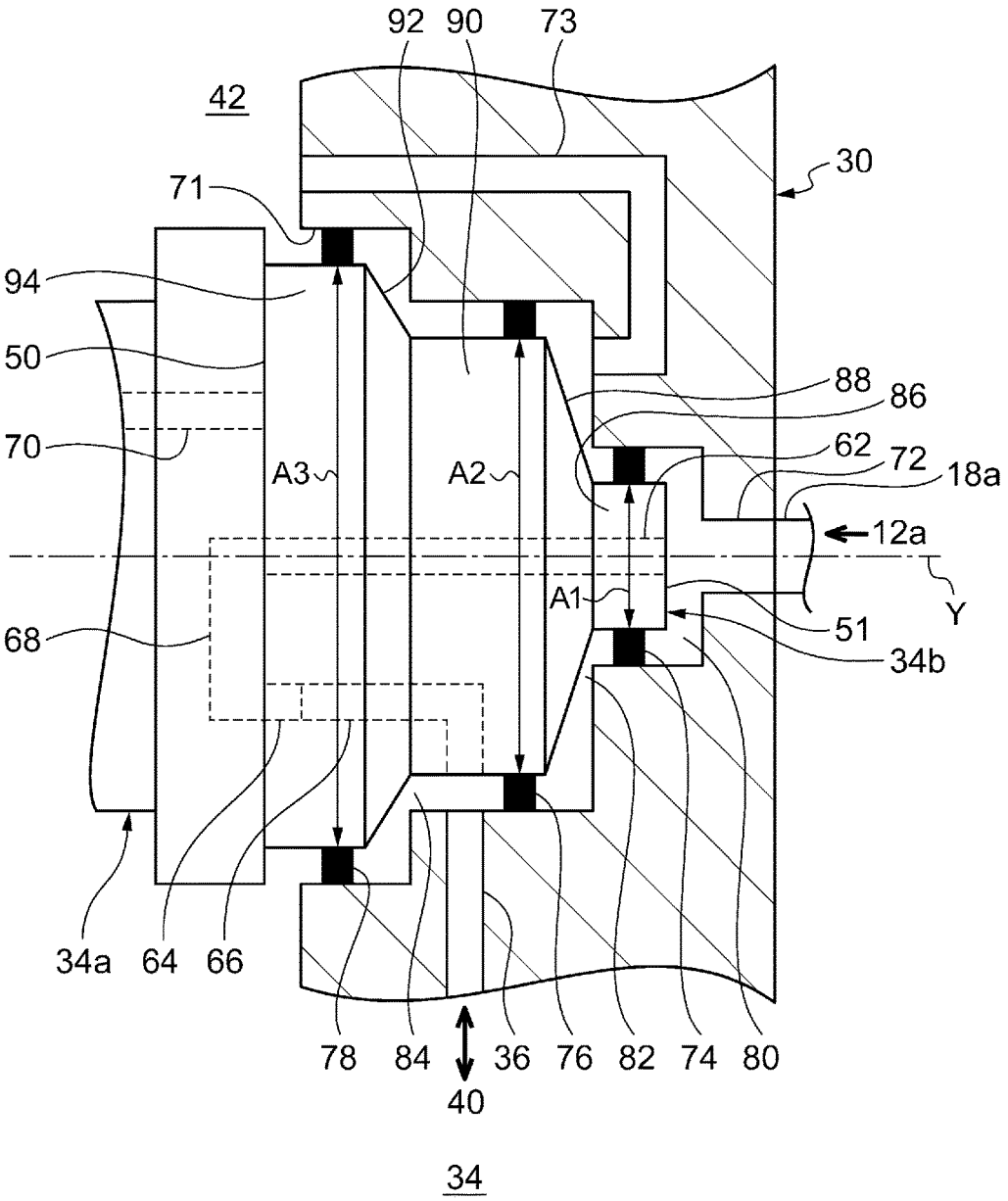
FIG. 7 is a view schematically showing a valve portion according to another embodiment and a peripheral structure thereof.

As shown in FIG. 7, the first stator stage portion 88 may be an inclined surface. In addition, the second stator stage portion 92 may be an inclined surface. In this way, at least one of the first stator stage portion 88 and the second stator stage portion 92 may not be a flat surface. Accordingly, compared to the case where the stage portions are flat, it is possible to alleviate a stress concentration in the valve stator 34*b*.

Figure 8:
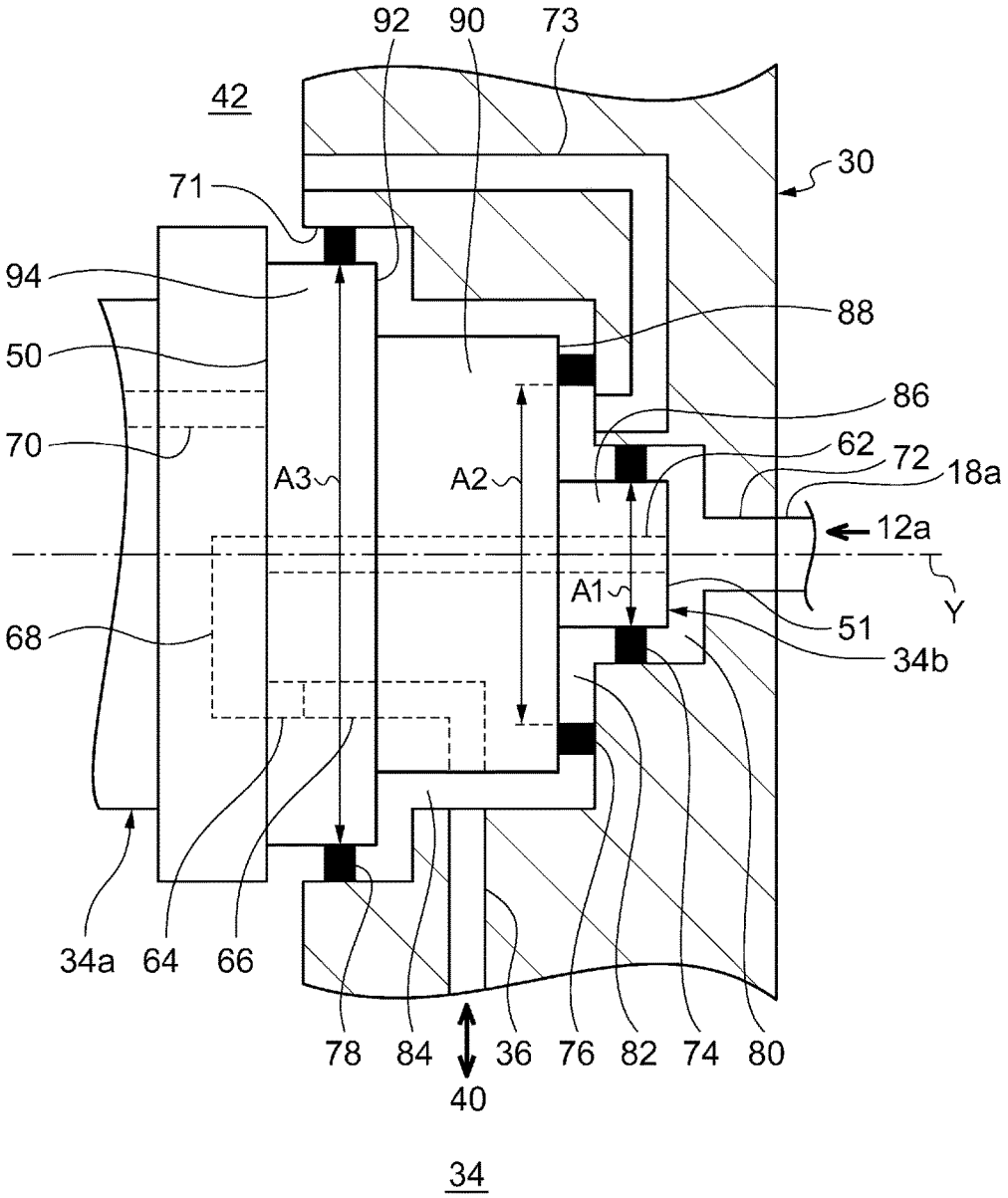
FIG. 8 is a view schematically showing a valve portion according to still another embodiment and a peripheral structure thereof.

As shown in FIG. 8, the second seal member 76 may be provided on the first stator stage portion 88. In this case, the second seal member 76 extends along the valve rotational axis Y between the housing 30 and the first stator stage portion 88. The second seal member 76 is mounted to be interposed between the first stator stage portion 88 and the stator receiving recessed surface 71. In this way, the variable pressure zone 84 is expanded to the first stator stage portion 88. Accordingly, the above-described assisting force can be applied not only to the second stator stage portion 92 but also to the first stator stage portion 88. Similarly to the above-described embodiment, it is possible to decrease the variation of the pressing forces applied to a portion between the valve stator 34*b* and the valve rotor 34*a* during a single cycle of the rotation of the valve portion 34 of the cryocooler 10.

In addition, the third seal member 78 may be provided on the second stator stage portion 92.

Figure 9:
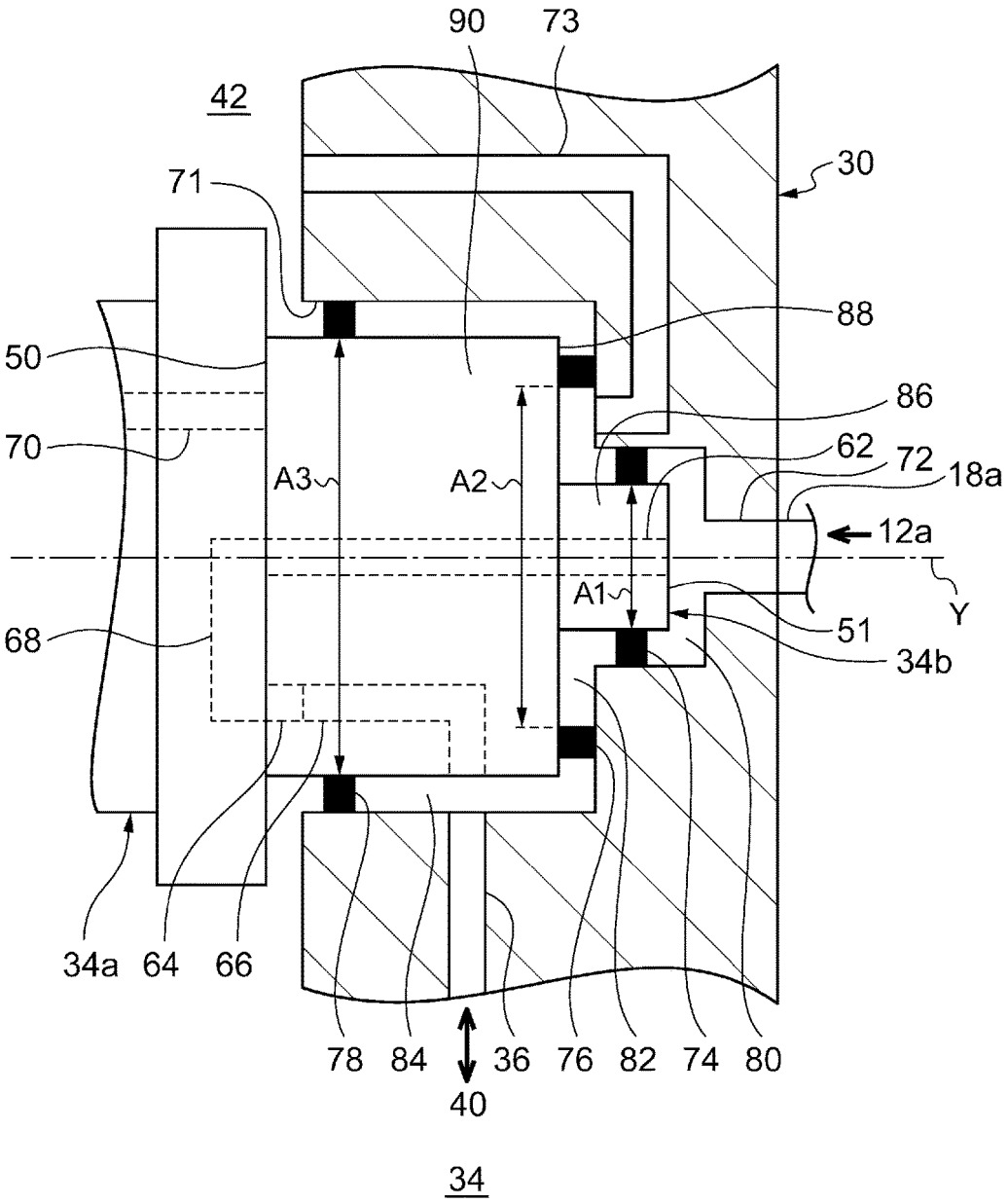
FIG. 9 is a view schematically showing a valve portion according to still another embodiment and a peripheral structure thereof.

As shown in FIG. 9, in a case where the second seal member 76 is provided on the first stator stage portion 88, the valve stator 34*b* may have a two-stage structure. In this case, the valve stator 34*b* does not include the second stator stage portion 92 and the third stator circumferential surface 94. Even in this way, it is possible to generate an assisting force using the first stator stage portion 88 and the variable pressure zone 84. Similarly to the above-described embodiment, it is possible to decrease the variation of the pressing forces applied to a portion between the valve stator 34*b* and the valve rotor 34*a* during a single cycle of the rotation of the valve portion 34 of the cryocooler 10.

In an embodiment, the constant-pressure zone is not limited to the low-pressure zone. The constant-pressure zone may be configured to hold another appropriate constant pressure such as an intermediate pressure between a high pressure and a low pressure.

In an embodiment, the outline of the valve stator 34*b* in the cross section along the plane perpendicular to the valve rotational axis Y is not limited to the circular shape, and may be other shapes.

In an embodiment, the communication path 66 may open to the third stator circumferential surface 94 between the second seal member 76 and the third seal member 78 in the direction of the valve rotational axis Y.

In the above-described embodiments, the embodiments are described in which the cryocooler is a single-stage GM cryocooler. However, the present invention is not limited to this, and the valve configurations according to the embodiments can be applied to a two-stage or a multiple-stage GM cryocooler, or can be applied to other cryocoolers such as a pulse tube cryocooler.

It should be understood that the invention is not limited to the above-described embodiment, but may be modified into various forms on the basis of the spirit of the invention. Additionally, the modifications are included in the scope of the invention.

What is claimed is:

1. A cryocooler, comprising:

a housing internally defining a low-pressure gas chamber;

a valve stator fixed to the housing in the low-pressure gas chamber, and defining a variable pressure zone and a high-pressure zone between the housing and the valve stator;

a valve rotor supported on the housing such as to be rotatable, around a valve rotational axis, with respect to the valve stator in the low-pressure gas chamber, and configured to interconnect the high-pressure zone with the variable pressure zone during a portion of a single cycle of rotation of the valve rotor, and to interconnect the low-pressure gas chamber with the variable pressure zone in another portion of the single cycle;

a first seal member extending lengthwise around the valve rotational axis between the housing and the valve stator, being disposed adjacent to the high-pressure zone to seal the high-pressure zone, and encompassing a first surface area;

a second seal member extending lengthwise around the valve rotational axis between the housing and the valve stator, being disposed adjacent to the variable pressure zone to seal the variable pressure zone, and encompassing a second surface area that is larger than the first surface area; and a third seal member extending lengthwise around the valve rotational axis between the housing and the valve stator, being disposed adjacent to the variable pressure zone to seal the variable pressure zone, and encompassing a third surface area that is larger than the second surface area.

2. The cryocooler according to claim 1, wherein:

the valve stator further defines a constant-pressure zone between the housing and the valve stator, in addition to defining the variable pressure zone and the high-pressure zone;

the first seal member is disposed such as to seal off the high-pressure zone from the constant-pressure zone; and the second seal member is disposed such as to seal off the variable pressure zone from the constant-pressure zone.

3. The cryocooler according to claim 2, wherein the housing includes a low-pressure introduction path through which the constant-pressure zone communicates with the low-pressure gas chamber.

4. The cryocooler according to claim 1, wherein the valve stator is provided with:

a first stator circumferential surface that from the valve rotational axis has a first radius, such as to define the first surface area;

a second stator circumferential surface that from the valve rotational axis has a second radius greater than the first radius, such as to define the second surface area, and being connected to the first stator circumferential surface; and a third stator circumferential surface that from the valve rotational axis has a third radius greater than the second radius, such as to define the third surface area, and being connected to the second stator circumferential surface; wherein the first seal member extends lengthwise around the valve rotational axis between the housing and the first stator circumferential surface, the second seal member extends lengthwise around the valve rotational axis between the housing and the second stator circumferential surface, and the third seal member extends lengthwise around the valve rotational axis between the housing and the third stator circumferential surface.

5. The cryocooler according claim 4, wherein the third radius and the second radius differ by not more than 10% of the valve stator's maximum radius.

* * * * *